US006984768B2

(12) United States Patent
Ginosar et al.

(10) Patent No.: US 6,984,768 B2
(45) Date of Patent: Jan. 10, 2006

(54) METHOD FOR DESTROYING HALOCARBON COMPOSITIONS USING A CRITICAL SOLVENT

(75) Inventors: Daniel M. Ginosar, Idaho Falls, ID (US); Robert V. Fox, Idaho Falls, ID (US); Stuart K. Janikowski, Rigby, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 462 days.

(21) Appl. No.: 10/152,599

(22) Filed: May 21, 2002

(65) Prior Publication Data

US 2003/0220532 A1 Nov. 27, 2003

(51) Int. Cl.
*A62D 3/00* (2006.01)

(52) U.S. Cl. ..... 588/316; 588/406

(58) Field of Classification Search ..... 588/206–208, 588/213, 209–212, 205, 226, 316, 406; 208/908, 208/909; 210/208, 209, 908, 909
See application file for complete search history.

(56) References Cited

U.S. PATENT DOCUMENTS

| | | | | |
|---|---|---|---|---|
| 4,338,199 A | * | 7/1982 | Modell | 210/721 |
| 4,351,978 A | | 9/1982 | Hatano et al. | |
| 4,543,190 A | * | 9/1985 | Modell | 210/721 |
| 4,806,514 A | | 2/1989 | Langford et al. | |
| 4,931,167 A | | 6/1990 | Wilwerding | |
| 4,950,833 A | | 8/1990 | Hawari et al. | |
| 5,043,054 A | | 8/1991 | Halpern et al. | |
| 5,141,629 A | | 8/1992 | Pri-Bar et al. | |
| 5,174,893 A | | 12/1992 | Halpern et al. | |
| 5,185,488 A | | 2/1993 | Hawari et al. | |
| 5,369,214 A | | 11/1994 | Farcasiu et al. | |
| 5,490,919 A | | 2/1996 | Pri-Bar et al. | |
| 5,780,669 A | | 7/1998 | Akiba et al. | |
| 5,994,604 A | | 11/1999 | Reagen et al. | |
| 6,124,519 A | * | 9/2000 | Sako et al. | 588/316 |

FOREIGN PATENT DOCUMENTS

| | | | |
|---|---|---|---|
| JP | 2-274269 | * | 11/1990 |
| JP | 11-263871 | * | 9/1999 |
| JP | 2001-79381 | * | 3/2001 |

OTHER PUBLICATIONS

Sako et al., "Dechlorination of PCBs with Supercritical Water Hydrolysis", Journal of Chemical Engineering of Japan, vol. 32, No. 6, pp. 830-832, published 1999.*
Chemical Abstract accession No. 133:212402: "Dechlorination of 1-chlorooctadecane, 9,10-dichlorostearic acid and 12,14-dichlorodehydroabietic acid in supercritical carbon dioxide", Aikawa et al., published 2000.*
Akimoto et al., "Dechlorination of 1-Chlorohexadecane and 2-Chloronaphthalene in Water under Sub- and Supercritical Conditions", Canadian Journal of Chemical Engineering, vol. 78, pp. 1151-1156, published Dec. 2000.*
Anitescu et al., "Supercritical Water Oxidation Reaction Pathway and Kinetics of Polychlorinated Biphenyls", Proceedings of the 2001 Conference on Environmental Research, Manhattan, KS, USA, May 21-24, 2001, Meeting Date 2001, pp. 40-51.*
Aikawa et al., "Catalytic dechlorination of 1-chlorooctadecane in supercritical carbon dioxide", Applied Catalysis B: Environmental, vol. 32, Issue 4, pp. 269-280, Aug. 30, 2001, available online Aug. 3, 2001.*
Full Translation of JP 2-274269, published Nov. 1990.*
Full Translation of JP 11-263871, published Sep. 1999.*
Full Translation of JP 2001-79381, published Jun. 2001.*
Aikawa et al., "Dechlorination of 1-chlorooctadecane, 9,10-dichlorostearic acid and 12,14-dichlorodehydroabietic acid in supercritical carbon dioxide", EnviroAnalysis 2000, Proceedings of the Biennial Internat'l. Conf., Ottawa, May 8-11, 2000, pp. 435-440.*
Berg, O., et al., "Column Chromatographic Separation of Polychlorinated Biphenyls from Chlorinated Hydrocarbon Pesticides, and their Subsequent Gas Chromatographic Quantitation in Terms of Derivatives", *Bulletin of Environmental Contamination & Toxicology*, vol. 7(6), pp. 338-346 (1972).
Cooke, M., et al., "Analysis of Polychlorinated Naphthalenes, Polychlorinated Biphenyls and Polychlorinated Terphenyls via Carbon Skeleton Gas-Liquid Chromatography," *Journal of Chromatography*, 156, pp. 293-299 (1978).
Cuppett, S., "Supercritical Fluid Cleaning", document from Concurrent Technologies Corporation Web Site (www.dppr.ctc.com), pp. 1-6 (Dec. 1995).
Kabir, A., et al., "Dechlorination of pentachlorophenol in supercritical carbon dioxide with a zero-valent silver-iron bimetallic mixture", *Green Chemistry*, vol. 3, pp. 47-51 (2001).

(Continued)

*Primary Examiner*—Stanley S. Silverman
*Assistant Examiner*—Ardith E. Hertzog
(74) *Attorney, Agent, or Firm*—Klass Law

(57) ABSTRACT

A method for destroying halocarbons. Halocarbon materials are reacted in a dehalogenation process wherein they are combined with a solvent in the presence of a catalyst. A hydrogen-containing solvent is preferred which functions as both a solvating agent and hydrogen donor. To augment the hydrogen donation capacity of the solvent if needed (or when non-hydrogen-containing solvents are used), a supplemental hydrogen donor composition may be employed. In operation, at least one of the temperature and pressure of the solvent is maintained near, at, or above a critical level. For example, the solvent may be in (1) a supercritical state; (2) a state where one of the temperature or pressure thereof is at or above critical; or (3) a state where at least one of the temperature and pressure thereof is near-critical. This system provides numerous benefits including improved reaction rates, efficiency, and versatility.

2 Claims, 1 Drawing Sheet

OTHER PUBLICATIONS

Wu, Q., et al., "Reductive dechlorination of polychlorinated biphenyl compounds in supercritical carbon dioxide", *Green Chemistry*, vol. 2, pp. 127-132 (2000).

Anitescu, G., et al., "Solubility of individual polychlorinated biphenyl (PCB) congeners in supercritical fluids: CO , CO /MeOH and CO /n-C.H.", *Journal of Supercritical Fluids*, vol. 14, pp. 197-211 (1999).

* cited by examiner

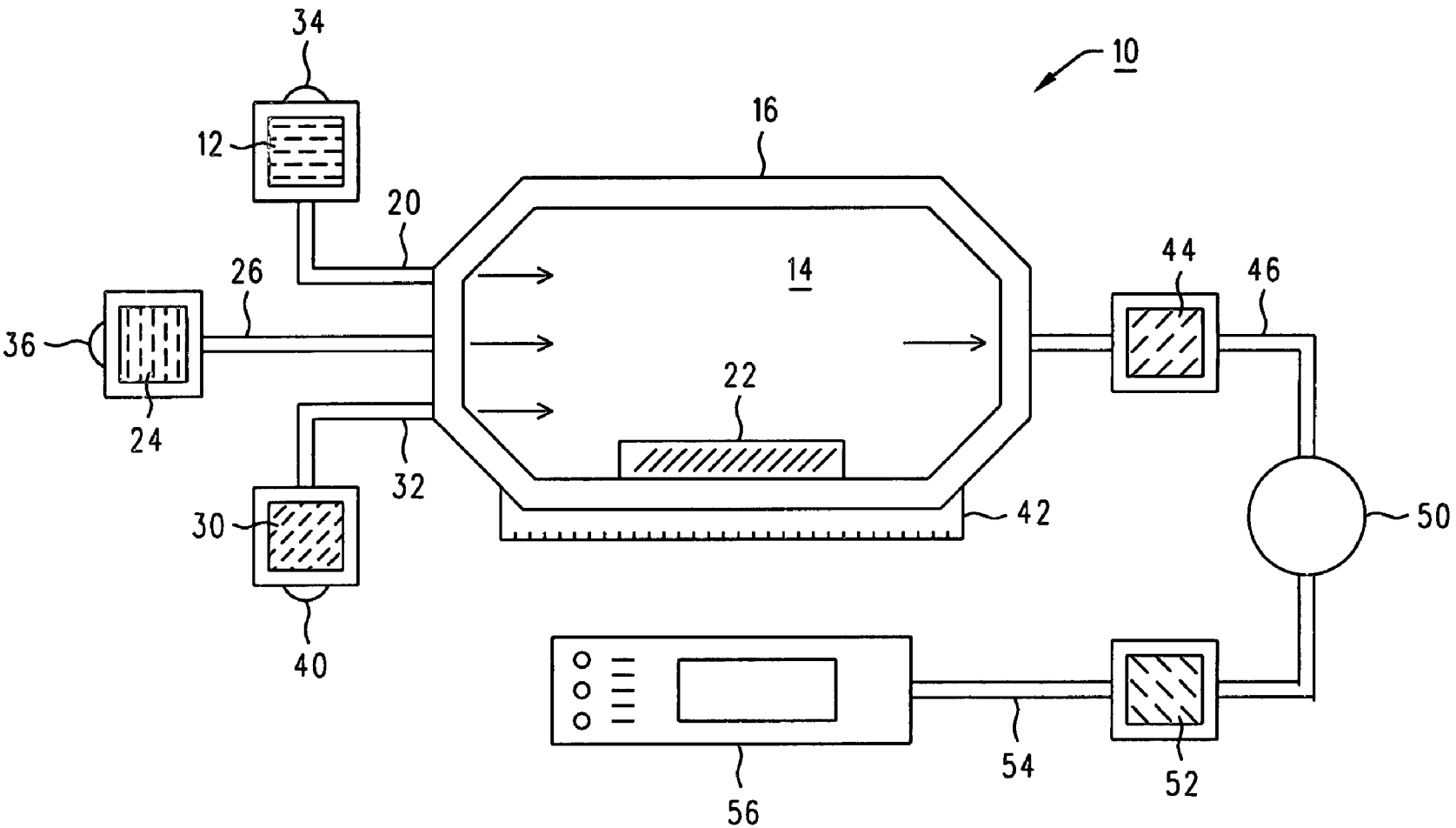
10
12
14
16
20
22
24
26
30
32
34
36
40
42
44
46
50
52
54
56

METHOD FOR DESTROYING HALOCARBON COMPOSITIONS USING A CRITICAL SOLVENT

CONTRACTUAL ORIGIN OF THE INVENTION

This invention was made with United States Government support under contract number DE-AC07-99ID13727, awarded by the United States Department of Energy. The United States has certain rights in this invention.

FIELD OF THE INVENTION

The present invention generally relates to the dehalogenation and resulting destruction of halocarbons and, more specifically, to a process for accomplishing this goal in a solvent-based process using specially selected temperature and/or pressure conditions. These conditions provide a multitude of benefits ranging from greater energy efficiency to increased reaction rates and improved versatility.

BACKGROUND OF THE INVENTION

From an environmental contaminant standpoint, halocarbons can present a number of ecological and health problems. These materials are therefore of significant concern from a biological standpoint. The term "halocarbon" as used herein shall encompass a compound having at least one carbon atom and at least one halogen atom. Of considerable importance within the general class of halocarbons discussed above are halogenated hydrocarbon materials (both of the aliphatic and aromatic variety). Halogens include the following chemical elements: fluorine (F), chlorine (Cl), bromine (Br), iodine (I), and astatine (At). Hydrocarbons traditionally encompass those materials which are constituted of only carbon and hydrogen. A combination of both materials (e.g. hydrocarbons+halogens) will result in the creation of halogenated hydrocarbons which, as noted above, are frequently capable of producing undesirable environmental effects and adverse health conditions. However, as will be discussed in considerable detail below, the present invention is applicable to all types of halocarbons whether or not they involve halogenated hydrocarbons. For example, in addition to encompassing halogenated hydrocarbons as previously noted, the term "halocarbon" as used in discussing the claimed processes shall also encompass without limitation perhalogenated materials and other halogenated organic compositions which are not hydrocarbons or halogenated hydrocarbons (for example, carbon tetrachloride and the like).

Halocarbons are typically generated in a variety of industrial processes including those associated with electronic component fabrication, dielectric applications, metal finishing procedures, paint production, plastics fabrication/recycling, oil manufacture, and other commercial activities. Representative halocarbons of particular concern include but are not limited to polyhalogenated aromatic and polyhalogenated polyaromatic compounds (for example, polychlorinated biphenyls), as well as aliphatic halides (e.g. polyhalogenated ethylene, chloroform, carbon tetrachloride, methylene chloride, and others without limitation).

A variety of disposal and destruction techniques have been investigated for the purpose of eliminating halocarbon compositions (with the terms "halocarbon", "halocarbon composition", "halocarbon material", and "halocarbon compound" being considered equivalent and used interchangeably herein). These methods include, for instance, burial at designated waste sites, incineration, photodecomposition, adsorption, and chemical degradation. One method of particular interest which has been extensively studied is the incineration of halocarbon waste compounds. However, a number of difficulties and disadvantages exist regarding this approach. For example, the incineration of halocarbons can yield additional hazardous airborne contaminants which are ultimately dispersed over a wide geographic area. Incineration processes likewise require high-temperature conditions and are therefore energy-intensive. Also of concern in the implementation of incineration procedures are the significant costs which are necessarily incurred in fabricating and operating large-scale incineration systems. Likewise, these techniques often function in a fairly slow manner, thereby creating a storage problem situation when large quantities of halocarbon compounds need to be incinerated.

Other techniques which have been developed for the destruction of halocarbons include the addition of alkaline solutions thereto as outlined in U.S. Pat. No. 4,351,978. In this patent, a procedure is described wherein alkaline compositions are combined with, for instance, polychlorinated biphenyls (PCBs) and alcohol dispersing agents. The foregoing technique (which employs Raney-type catalysts) requires the establishment and maintenance of controlled alkaline conditions in order to sustain the reactive capabilities of the chosen catalyst(s). It also requires the addition of gaseous hydrogen ($H_2$) in order to properly implement the necessary halogen-hydrogen substitution reactions which are needed for effective dehalogenation. Another technique for destroying halocarbons (disclosed in U.S. Pat. No. 4,931,167) requires the use of Lewis acid catalysts under anhydrous conditions at temperatures in excess of 300° C. Factors to be considered in the foregoing procedures (and others) include the employment of costly and potentially-reactive (e.g. dangerous) reagents in the destruction process and the hazards associated therewith.

Additional dehalogenation/destruction techniques and/or related technologies are disclosed in, for example, U.S. Pat. Nos. 4,806,514; 4,950,833; 5,043,054; 5,141,629; 5,174,893; 5,185,488; 5,369,214; 5,490,919; 5,780,669; and 5,994,604. Notwithstanding the processes discussed above and incorporated within the foregoing references, the present invention offers a considerable advance in the art of halocarbon destruction. The claimed procedures provide numerous benefits which, particularly from a collective standpoint, had not been achieved prior to the present invention. In this regard, the processes described below satisfy a long-felt need for a dehalogenation method which accomplishes the following benefits and goals simultaneously (with the foregoing list not being considered exhaustive): (1) improved reaction rates; (2) more advantageous material transport characteristics (e.g. favorable "mass transport" properties) resulting in the rapid and efficient production of dehalogenated products; (3) the ability to avoid generating large quantities of additional toxic materials as reaction by-products; (4) a high level of versatility with particular reference to the types of compositions that can be dehalogenated; (5) reduced production facility costs compared with, for instance, incineration systems; (6) the elimination of high-temperature combustive reactors and the energy requirements associated therewith; (7) the ability to accomplish complete destruction of the desired halogenated compounds without requiring highly reactive (e.g. dangerous) reducing agents and other comparable materials; (8) the further ability to employ low-cost and safer reactants; (9) the implementation of processes which are cost effective, readily controllable (e.g. customizable on-demand), easily scaled up or down as needed, and capable of rapid integration with other processing systems including those used for extraction and separation of reaction products; (10) greater catalyst life; (11) enhanced and improved catalyst cleaning characteristics; (12) more advantageous reaction kinetics; (13) the ability in certain situations to recycle reaction products back into the system for use as reactants and in various related applications; and other benefits.

As outlined above, the claimed processes are characterized by a multitude of specific benefits in combination. These benefits include but are not limited to items (1)–(13) recited above both on an individual and simultaneous basis which are attainable in a substantially automatic manner (with the simultaneous achievement of such goals being of particular importance and novelty). The attainment of these objectives is especially important regarding the following specific items: a high reaction rate, improved mass transport characteristics, lower overall temperature requirements, greater system versatility/controllability, better safety, enhanced catalyst cleaning capabilities, and improved overall efficiency compared with previous destruction techniques. The catalytic dehalogenation procedures set forth herein and in the various embodiments associated therewith perform all of the functions mentioned above in a uniquely effective and simultaneous manner while using a minimal number of reactants, equipment, labor, and operational requirements. As a result, dehalogenation processes of minimal complexity and high effectiveness are created that nonetheless exhibit a substantial number of beneficial attributes in an unexpectedly efficient fashion. In this regard, the developments disclosed herein represent an important advance in waste treatment technology (with particular reference to halocarbons). Specific information concerning the novel process steps and reaction conditions associated therewith (which, in particular, constitute a substantial departure from prior methods) will be presented below in the following Summary, Brief Description of the Drawing, and Detailed Description sections.

SUMMARY

The following discussion shall constitute a brief and non-limiting general overview. More specific details concerning particular embodiments and other important features (including a recitation of preferred reactants, reaction conditions, material quantities, and other aspects of the claimed processes) will again be recited in the Detailed Description section set forth herein.

In accordance with the present invention, highly effective processes are disclosed for dehalogenating and otherwise destroying halocarbons. The term "halocarbon" as used herein and claimed shall be construed in the broadest manner possible to incorporate all compositions which include at least one carbon atom and at least one halogen atom associated therewith (e.g. as part of their formulae). Of particular interest within the general class of halocarbons mentioned above are the halogenated hydrocarbons which will be extensively discussed in the Detailed Description section. The techniques outlined herein are specifically characterized by the multiple benefits listed above which clearly distinguish the claimed methods from prior procedures. In particular, the processes of interest are characterized by the employment of distinctive and unique reaction conditions, the selection and implementation of which represent a substantial departure from previous dehalogenation approaches.

A supply of a chosen halocarbon is first selected for treatment. As previously stated, an advantageous feature of the present invention is the ability thereof to process virtually all types of halocarbons including but not limited to halogenated hydrocarbons and other halogen-containing compositions (e.g. halogenated alcohols and the others). This benefit is achieved using the specialized solvent system and novel reaction conditions pertaining thereto as explained in considerable detail below. Thereafter, the halocarbon compound is combined with a solvent in the presence of a catalyst in order to generate a dehalogenated product (namely, the dehalogenated analog of the halocarbon starting material). Use of the phrase "in the presence of" with particular reference to the catalyst and its relationship to the various reactants/starting materials discussed herein shall likewise be interpreted in the broadest possible manner. Specifically the foregoing phrase shall involve a situation wherein the catalyst is in sufficient proximity with the solvent, halocarbon, and any other reactants in order to entirely or partially catalyze the dehalogenation reaction. Preferably, the catalyst will be in direct physical contact with the foregoing ingredients.

A wide variety of solvent materials and catalysts can be used for the purposes expressed herein as will be listed below in the Detailed Description section. At least two basic solvent types can be employed within the claimed reaction processes. The first type involves a solvent composition which contains as part of its chemical structure (e.g. formula) at least one hydrogen (H) atom. This particular solvent is most frequently referred to hereinafter as a "hydrogen-containing solvent". The second solvent type consists of a solvent material which does not contain any hydrogen atoms as part of its chemical structure (e.g. formula). It is most frequently referred to hereinafter as a "non-hydrogen-containing solvent". However, it should also be noted that, unless otherwise indicated, the term "solvent" shall be construed throughout this discussion to collectively encompass all solvent types applicable to the claimed processes including but not limited to both of the varieties recited above.

In certain situations as determined by routine preliminary testing and other parameters to be outlined in greater detail below, one or more additional (e.g. supplemental) ingredients may be added to the solvent and halocarbon. These additional compositions are specifically used to supply hydrogen to the reaction process. Hydrogen is a key component in the substitution reaction which occurs as part of the overall dehalogenation procedure (namely, replacement of the halogen atom[s] in the halocarbon compound with one or more hydrogen atoms). Of primary interest in accomplishing this goal is the addition of a material to the foregoing mixture which is designated herein as a "hydrogen donor composition", "hydrogen donor", "supplemental hydrogen donor composition", or "supplemental hydrogen donor". This ingredient is added on an "as-needed" basis depending primarily on the chemical nature of the solvent being used. For example, in situations involving the use of non-hydrogen-containing solvents, the hydrogen donor composition will typically be employed (since the solvent, itself, is not capable of hydrogen donation). Likewise, in certain cases where hydrogen-containing solvents are used which deliver only minimal or insufficient amounts of hydrogen, optimum results are achieved when a hydrogen donor is incorporated into the reaction mixture (typically known as a "supplemental hydrogen donor composition" or "supplemental hydrogen donor" in such a situation). Additional information as to when this type of material is typically used in the claimed reaction processes will be presented later. However, the terms "hydrogen donor composition" and "hydrogen donor" shall be construed herein to generally encompass both supplemental and non-supplemental hydrogen donor compounds.

It should be recognized at this point that the claimed invention shall not be restricted or otherwise limited to any particular halocarbons, solvents, hydrogen donor compositions, supplemental hydrogen donor compositions, catalysts, and the like unless otherwise expressly stated herein. In this regard, the claimed methods shall not be considered "reagent-specific" or "reactant specific". Likewise, the foregoing procedures may occur in a wide variety of processing systems and reactors using various components and hardware without limitation.

During at least part or (preferably) all of the dehalogenation reactions associated with this invention, the solvent is maintained at carefully-selected pressure and/or temperature conditions. It should be understood that the conscious selection and implementation of these particular conditions with particular reference to the physical state of the solvent are instrumental in achieving the many benefits listed above. These benefits include but are not limited to increased reaction rates, improved mass transport levels, enhanced solubility of the halocarbon within the solvent, better catalyst cleaning characteristics, and the like. It is therefore an inventive and novel approach to employ the reaction conditions discussed herein and to intentionally choose these conditions over others. As previously noted, these reaction conditions specifically involve the pressure and/or temperature of the solvent during at least part or (preferably) all of the dehalogenation processes outlined herein. Incidentally, in discussing the reaction techniques of interest, use of the term "maintaining" or "maintained" with particular reference to the claimed solvent temperature and/or pressure conditions shall be construed to encompass the maintenance of such conditions during all or at least some portion of the procedures under consideration. Furthermore, use of the term "reactants" herein shall be interpreted to encompass one or more of the starting materials that are employed in the claimed dehalogenation processes (e.g. halocarbons, solvents, hydrogen donor compositions, catalysts, and others if needed).

In accordance with the present invention and with particular reference to the solvent, it is initially determined what the critical temperature ($T_c$) and critical pressure ($P_c$) are for the particular solvent material being employed. Definitions for critical temperature ($T_c$) and critical pressure ($P_c$) will be provided below. Thereafter, the solvent (whether or not it includes hydrogen as part of its overall structure) is optimally maintained at one of the following conditions during treatment of the selected halocarbon compound:

(A) Condition No. 1—A supercritical state (namely, where the temperature (T) of the solvent is at or above its critical temperature ($T_c$) and the pressure (P) of the solvent is at or above its critical pressure ($P_c$). Where supercritical conditions are employed, a preferred version of this particular embodiment will involve a situation where the solvent is maintained at a temperature (T)=about ($T_c$) to [(2)($T_c$)] and a pressure (P)=about ($P_c$) to [(50)($P_c$)]. It shall be understood that, regarding all of the numerical parameters discussed herein, such values shall not be considered limiting and instead constitute preferred operating conditions designed to provide optimum results. Furthermore, in all of the relationships expressed herein involving the temperature (T), near-critical temperature ($T_{nc}$) [defined below], and critical temperature ($T_c$) of the solvent which include numerical values associated therewith, the listed temperature relationships shall all be interpreted in the current discussion and in the claims as if they were on an "absolute" temperature scale (e.g. in ° K [wherein ° K=° C.+273.16] or ° R [wherein ° R=° F.+459.67]). Likewise, in all of the relationships expressed herein involving the pressure (P), near-critical pressure ($P_{nc}$) [defined below], and critical pressure ($P_c$) of the solvent which include numerical values associated therewith, the listed pressure relationships shall all be interpreted in the current discussion and in the claims as if they were on an "absolute" pressure scale (e.g. in atmospheres ["atm"] or pounds per square inch absolute ["psia"] as opposed to "gauge" pressure [for example, pounds per square inch gauge or "psig"]). Further information concerning this aspect of the present invention will be set forth below in the Detailed Description section.

(B) Condition No. 2—A state wherein the solvent is maintained at a temperature (T)≧($T_c$) and a pressure (P)≦($P_c$) during the aforesaid reaction. It should be noted that, in such an embodiment, an exemplary and preferred pressure (P) level will involve a situation where the pressure (P) of the solvent is ≧about [(0.1)($P_c$)]. Likewise, a representative and preferred solvent temperature (T) will be sustained at a level=about ($T_c$) to [(2)($T_c$)] (see the comments provided above involving absolute temperature and pressure scales which are applicable to all of the numerical relationships set forth in this paragraph).

(C) Condition No. 3—A state wherein the solvent is maintained at a temperature (T)≦($T_c$) and a pressure (P)≧($P_c$) during the aforesaid reaction. In this particular embodiment, an exemplary and preferred solvent pressure (P) level will involve a situation where the pressure (P) of the solvent= about ($P_c$) to [(50)($P_c$)]. Likewise, a representative and preferred solvent temperature (T) will be sustained at a level which is ≧about [(0.9)($T_c$)] (see the comments provided above involving absolute temperature and pressure scales which are likewise applicable to all of the numerical relationships set forth in this paragraph).

(D) Condition No. 4—A state wherein the solvent is maintained at a temperature (T)≦($T_c$) and a pressure (P) which is ≧about [(0.1)($P_c$)] and ≦($P_c$) [e.g. [(0.1)($P_c$)]≦(P)≦($P_c$)] during the aforesaid reaction (with the foregoing pressure [P] value being designated herein to encompass a "near-critical" pressure condition as further discussed below). When this particular embodiment is implemented, a representative and preferred solvent temperature (T) will be ≧about [(0.9)($T_c$)]. In addition, see the comments provided above involving absolute temperature and pressure scales which are applicable to all of the numerical relationships set forth in this paragraph.

(E) Condition No. 5—A state wherein the solvent is maintained at a pressure (P)≦($P_c$) and a temperature (T) which is ≧about [(0.9)($T_c$)] and ≦($T_c$) [e.g. [(0.9)($T_c$)]≦(T)≦($T_c$)] during the aforesaid reaction (with the foregoing temperature [T] value being designated herein to encompass a "near-critical" temperature condition as further discussed below). When this particular embodiment is implemented, a representative and preferred solvent pressure (P) is ≧about [(0.1)($P_c$)]. Again, see the comments provided herein involving absolute temperature and pressure scales which are applicable to all of the numerical relationships set forth in this paragraph.

More specific information concerning all of the above-listed embodiments will be provided below in the Detailed Description section including explicit definitions of "supercritical", "critical temperature", "critical pressure", "near-critical temperature", "near-critical pressure", and the like. It should also be understood that all of the embodiments set forth herein have a single common feature, namely, maintenance during the claimed reaction processes of at least one of the solvent pressure (P) and solvent temperature (T) at a "critical" state. Specifically, such a "critical" state shall be defined to involve a situation where at least one of the solvent pressure (P) and solvent temperature (T) are at near-critical (see the definition provided below), critical, or supercritical values. This particular development (with specific reference to the conscious and intentional selection of these parameters over the multitude of others that are theoretically possible) constitutes an important and unique inventive concept which directly accomplishes the many attributes recited herein. Specifically, by maintaining the solvent temperature (T) and/or pressure (P) in a near-critical, critical, or above-critical, the improved mass transport of reactants is facilitated as previously discussed. Likewise, by employing the solvent conditions generally outlined above, the overall solubility of the reactants (including the chosen halocarbon) within the solvent is substantially enhanced, thereby leading to greater overall versatility, reduced energy consumption, increased dehalogenation capacity, and the like. Accordingly, the developments expressed herein represent an important advance in waste treatment technology with specific reference to the destruction of halocarbons as previously stated.

Catalytic reaction of the solvent, halocarbon, and hydrogen donor composition (if used) in the manner discussed above will efficiently generate a dehalogenated product which is ultimately separated from the remaining components by conventional means. At this stage, the reaction process is completed. As previously stated, the summary provided above shall not limit the invention in any respect and is instead being provided as a brief overview of the claimed technology from a general standpoint. The Detailed Description section set forth below will offer explicit and enabling information regarding the foregoing subject matter including data involving the materials being used and the reaction conditions of interest.

BRIEF DESCRIPTION OF THE DRAWING

The drawing FIGURE provided herein is schematic and not necessarily drawn to scale. It shall not limit the scope of the invention in any respect. Any physical components or structures shown in the drawing are representative only and are not intended to restrict the invention or its implementation. In particular, the claimed reaction processes are not limited to any specific hardware, processing equipment, arrangements of components, and the like, with the invention not being "reactor-specific" in any fashion. Likewise, the current invention is not restricted to any particular order or sequence in which the desired reactants are combined or otherwise introduced, with any representations of the same in the drawing FIGURE being presented for example purposes only. The use of any symbolic elements in the FIGURE regarding various materials, reactants, and the like which are employed in the claimed processes shall also be considered exemplary and non-restrictive.

The FIGURE is a schematically-illustrated view of the reactants and a representative reactor which may be employed in the processes of the claimed invention. No scale or size relationships shall be construed from the drawing.

DETAILED DESCRIPTION

As previously discussed, the invention set forth herein involves a highly efficient process for dehalogenating a wide variety of halocarbons. The term "halocarbon" as used herein shall encompass a compound having at least one carbon atom and at least one halogen atom. Likewise, the terms "halocarbon", "halocarbon composition", "halocarbon material", and "halocarbon compound" shall be considered equivalent and are used interchangeably herein. Of considerable importance within the general class of halocarbons discussed above are halogenated hydrocarbon materials (both of the aliphatic and aromatic variety). Halogens include the following chemical elements: fluorine (F), chlorine (Cl), bromine (Br), iodine (I), and astatine (At). Hydrocarbons traditionally encompass those materials which are constituted of only carbon and hydrogen. A combination of both materials (e.g. hydrocarbons+halogens) will result in the creation of halogenated hydrocarbons which, as noted above, are frequently capable of producing undesirable environmental effects and adverse health conditions. However, as will become readily apparent from the discussion provided below, the present invention is applicable to all types of halocarbons whether or not they involve halogenated hydrocarbons. For example, the term "halocarbon" as employed throughout this discussion shall likewise include a wide variety of halogenated organic compounds aside from halogenated hydrocarbons, with examples of such materials involving, for instance, halogenated alcohols, aliphatic halocarbons, aromatic halocarbons, and other heteroatomic substituted halocarbons. In addition to encompassing halogenated hydrocarbons and the other materials outlined above, the term "halocarbon" as used in discussing the claimed processes shall also encompass without limitation perhalogenated materials and other halogenated organic compositions which are not hydrocarbons or halogenated hydrocarbons (for example, carbon tetrachloride and the like). Furthermore, the other definitions set forth above in the Summary section shall likewise be applicable to the current Detailed Description.

As will become readily apparent from the following discussion, the claimed processes basically involve the catalytic destruction (i.e. dehalogenation) of the chosen halocarbon compounds using a hydrogen substitution reaction in a solvent system. By maintaining the solvent in a "critical" state during part or preferably all of the reaction processes, a multitude of benefits are achieved ranging from improved mass transport properties (and greater reaction rates) to enhanced salvation characteristics leading to superior overall versatility. The discussion of these and other benefits as provided above is incorporated in the current description by reference. As a result, a wide variety of different halocarbon compounds may be effectively processed using the claimed methods without limitation. All of the particular reaction conditions which can be used to maintain the solvent in a "critical" state were briefly described in the Summary section above and will be explained in considerably greater detail below.

It should be understood that the term "dehalogenation" shall be employed in a conventional fashion throughout this discussion to encompass a general process wherein halocarbon compounds are chemically reacted to remove the halogen atom(s) associated therewith. As a result, dehalogenated products are generated. In dehalogenation techniques of the type disclosed herein, a "substitution" reaction occurs wherein the removed halogen atom(s) combine with one or more of the chemical reactants. This procedure yields acid materials or other compositions which present significantly-reduced or negligible risks from a health, environmental, and safety standpoint compared with the original halocarbon materials. Likewise, in the present invention, the dehalogenation process is further characterized by an unexpectedly high degree of operational efficiency as previously noted.

At this point, the claimed techniques will be discussed in depth with particular reference to the preferred reactants, operating conditions, and other parameters associated therewith. All of the various embodiments disclosed herein shall not be limited to any specific reactants, reactor equipment, separatory components, material quantities, and the like unless otherwise expressly stated herein. Likewise, all scientific terms used throughout this discussion shall be construed in accordance with the traditional meanings attributed thereto by individuals skilled in the art to which this invention pertains unless a special definition is provided below. The numerical values listed in this section and in the other sections of the present description constitute preferred embodiments designed to offer optimum results and shall not limit the invention in any respect. In particular, it shall be understood that the specific embodiments disclosed herein and illustrated in the drawing FIGURE constitute special versions of the claimed reaction processes which, while non-limiting in nature, can offer excellent results and are highly distinctive. All recitations of chemical formulae and structures in the following discussion are intended to generally indicate the types of materials which may be used. The listing of specific chemical compositions which fall within the general formulae and classifications presented below are offered for example purposes only and shall be considered non-limiting unless explicitly stated otherwise. The invention discussed herein and all of its various embodiments shall likewise not be restricted with particular reference to the order in which the claimed chemical reactants are combined or otherwise introduced into the processing system of interest. Likewise, as previously stated, the novel techniques disclosed in this section shall not be considered "reactor-specific" and may be implemented in a variety of different reactor systems (both "batch" and "continuous") without limitation.

Finally, any and all recitations of structures, materials, chemicals, and components in the singular throughout the claims, Summary, and Detailed Description sections (for example, by using "a", "an", or other comparable words) shall also be construed to encompass a plurality of such items unless otherwise explicitly noted herein. Employment of the phrase "at least one" shall be construed in a conventional fashion to involve "one or more" of the listed items, with the term "at least about" being defined to encompass the listed numerical value and values in excess thereof. Use of the word "about" in connection with any numerical terms or ranges shall be interpreted to offer at least some latitude both above and below the listed parameter(s) with the magnitude of such latitude being construed in accordance with current and applicable legal decisions pertaining to this terminology. Furthermore, all of the definitions, terms, and other information recited above in the Background and Summary sections are applicable to and incorporated by reference in the current Detailed Description section. In order to facilitate a full and complete explanation of the invention and its various embodiments, each individual reactant/starting material will first be discussed followed by an explanation of the novel operating parameters employed in the claimed dehalogenation processes.

A. The Halocarbons

As previously stated, the claimed invention and all of its various embodiments shall not be limited to the treatment of any particular halocarbon compounds or classes thereof. The specialized operating conditions recited in considerable detail below with particular reference to the solvent temperature (T) and/or pressure (P) enable a wide variety of different halocarbons to be treated without restriction. For example, representative classes and sub-classes of halocarbon compositions that can be dehalogenated using the procedures disclosed herein include, without limitation, halogenated aromatic compounds, halogenated polyaromatic compounds, halogenated aliphatic compounds, polychlorinated biphenyls (PCB compounds), polychlorinated p-dibenzo dioxins, polychlorinated dibenzo furans, halogenated insecticides/pesticides (for example, "DDT"), halogenated herbicides (e.g. "2,4-D"), freon compounds, hydrofluorocarbons ("HFC" materials), chlorofluorocarbons ("CFC" compositions), bromofluorocarbons ("BFC" compounds), nerve gases (e.g. "VX" and "mustard gas"), halogenated fire suppressants, halogenated medical wastes, halogenated industrial process wastes (including but not limited to chlorohydrins, chlorophenols, and the like), mixtures thereof, and others. Representative specific halocarbon compounds which can be processed in accordance with the methods discussed below include but are not limited to p-dichlorobenzene, orthochlorophenol, 2-chloro-1,1-biphenyl, 1,1-dichloroethane, 1,1,1-trichlorobenzene, trichloroethane, trichloroethylene, tetrachloroethylene, methylene chloride, chlorobenzene, and others (alone or in combination).

Again, it must be emphasized that the foregoing lists should not be considered exhaustive in accordance with the significant versatility of the present invention. The chosen halocarbons can be treated in a variety of forms and phases including but not restricted to diluted and undiluted (e.g. concentrated) liquid formulations. Thermally or physically vaporized halocarbon compounds can likewise be processed effectively. All types of halogens can be removed using the claimed methods including chlorine (Cl), bromine (Br), iodine (I), fluorine (F), and astatine (At). Single-component supplies of halocarbons can be processed using the inventive procedures of interest although, in the alternative, mixtures of one or more of the foregoing materials (and/or others) can be dehalogenated in any proportions, amounts, combinations, or states. Accordingly, the present invention shall not be restricted to any types, amounts, combinations, phases, or forms regarding the halocarbon compositions which are chosen for destruction.

With reference to the schematic illustration of the FIGURE, an exemplary processing system 10 is shown which includes a supply 12 of a halocarbon that is ready for treatment (e.g. dehalogenation). The supply 12 of halocarbon is operatively connected to and in fluid communication with the interior region 14 of a reactor vessel 16 via tubular conduit 20. The reactor vessel 16, conduit 20, and all other conduits, hardware, and components associated therewith (including those discussed below) may be made from any suitable material known in the art for the purposes expressed herein including but not limited to heat and corrosion-resistant steels, nickel alloys, ceramics, quartz (with particular reference to the use of this material as a lining), and the like. Again, the system 10 shown in the FIGURE is provided in schematic form for example purposes only and shall not restrict the invention in any respect. It should also be emphasized that, while preferred materials suitable for use as the supply 12 of halocarbon will optimally involve halogenated hydrocarbons, other halogenated carbon-containing compositions can also be treated which would not be considered halogenated hydrocarbons in accordance with the definition provided herein. Examples of these other materials are recited above and incorporated in this discussion by reference. Likewise, the supply 12 of halocarbon can be delivered to the reactor vessel 16 in liquid form, as a vapor in combination with a heated or unheated carrier gas or, alternatively, with a critical fluid (not shown). Representative carrier gases include, for instance, carbon dioxide ($CO_2$), nitrogen ($N_2$), hydrogen ($H_2$), air, helium (He), argon (Ar), neon (Ne), krypton (K), zenon (Ze), radon (Ra), or mixtures thereof without limitation. However, it should be recognized that, in the claimed processes, carrier gases are not required and should be considered optional. The absence thereof constitutes a preferred embodiment with the understanding that they can be employed if desired as determined by routine preliminary pilot testing. Likewise, when delivered in a liquid state, the supply 12 of halocarbon may be in substantially "pure" form without any other materials associated therewith or in a variety of different solutions including those which are formulated using one or more alcohols and/or hydrocarbon diluents without limitation. It should likewise be understood that the quantity of halocarbon compound which can be treated using the claimed processes shall not be limited to any particular amounts and will generally depend on the size/capacity of the processing system 10.

B. The Catalyst

With continued reference to the FIGURE, a supply (e.g. bed) 22 of a chosen catalyst is schematically illustrated within the interior region 14 of the reactor vessel 16. As previously stated in connection with the supply 12 of halocarbon, the catalyst which may be employed in the various embodiments of the current invention can involve a number of different compositions (both supported and unsupported) without restriction. For example, many different catalysts can be used including those selected from the group consisting of metal salts, inorganic oxides, supported metals, unsupported metals, or combinations thereof. Supported or unsupported metals which can be chosen for use as catalysts in the dehalogenation procedures set forth herein can, for instance, be found in Group VIII of the periodic table and include but are not limited to platinum (Pt), nickel (Ni), palladium (Pd), cobalt (Co), rhodium (Rh), iridium (I), or combinations thereof. In addition, copper (Cu) and zinc (Zn) can also be employed as the catalyst. It is therefore self-evident that a wide variety of catalysts can be used to effectively accomplish dehalogenation. The optimum catalyst composition which may be associated with any given halocarbon compound can be chosen in accordance with routine preliminary pilot studies involving a variety of parameters including the desired reaction conditions, starting materials, and the like.

It should be noted that a "supported metal" is conventionally defined herein to involve a metal which is attached to or coated onto a suitable "carrier" or "support" structure. Preferred carrier and support structures include but are not restricted to alumina ($Al_2O_3$), magnesia ($Mg_2O_3$), titania ($TiO_2$), silica ($SO_2$) lanthana ($La_2O_3$), calcia (CaO), zirconia ($ZrO_2$), carbon (C), or combinations thereof. Conversely, an "unsupported metal" shall be construed to involve a selected metal which is not used in connection with any carrier or support structure. Exemplary unsupported metals which can be employed as catalysts are selected from the group consisting of zinc (Zn), copper (Cu), nickel (Ni), cobalt (Co), iron (Fe), platinum (Pt), palladium (Pd), gold (Au), silver (Ag), rhodium (Rh), iridium (Ir), or combinations thereof. Representative supported metals that are appropriate for incorporation within the processes of the present invention as effective catalytic agents involve (without restriction) the following materials: $Pt/Al_2O_3$, $Ni/Al_2O_3$, $Pd/Al_2O_3$, $Co/Al_2O_3$, $Rh/Al_2O_3$, $Ir/Al_2O_3$, or combinations thereof. Likewise, it should be understood that, with respect to these supported metals, the alumina ($Al_2O_3$) structures associated therewith can be readily replaced with any of the alternative carriers and support materials recited above (or other equivalent compositions).

While effective results have been obtained by merely placing the above-mentioned catalyst compositions within the interior region 14 of the reactor vessel 16 as schematically illustrated, other configurations are equally viable. For example, a design may be used if desired in which the supply 22 of catalyst is placed on a substrate made from glass (not shown). Likewise the catalyst may be impregnated within a fiber matrix or a zeolite cake (also not shown). While the claimed invention shall not be restricted to any particular configuration in connection with the catalyst, the use of support structures with the catalyst (including those recited above) can possibly alleviate liquid accumulation and the difficulties associated therewith which may occur in certain applications.

It should again be noted that the supply 22 of catalyst illustrated in the FIGURE is presented in schematic format for example purposes only and, accordingly, other structural forms, configurations, support components, and the like may be adopted as needed and desired in accordance with routine preliminary pilot examination. Use of the phrase "in the presence of" with specific reference to the catalyst and its relationship to the various reactants discussed herein shall be construed in the broadest possible manner. Specifically, this phrase will involve a situation wherein the catalyst is in sufficient proximity with the solvent (discussed below), halocarbon compound, and any other reactants in order to entirely or partially catalyze the desired dehalogenation reaction. Preferably, the catalyst will be in direct physical contact with the foregoing ingredients.

Regarding the amount of catalyst to be employed in connection with the supply 22, this parameter may also be varied as necessary without limitation. In particular and in most situations, the catalyst quantity is related to the specific halocarbon under consideration, with appropriate values for this parameter being determined by routine preliminary analysis. However, in an exemplary and preferred (e.g. non-restrictive) embodiment which is prospectively applicable to all of the various versions of the claimed reaction process, representative halocarbon weight hourly space velocities will involve about 0.01–50 Kg of the selected halocarbon (optimum=about 0.1–10 Kg) per Kg of the chosen catalyst composition per hour ($hr^{-1}$). As used herein and in a conventional fashion, the term "weight hourly space velocity" is defined as the halocarbon feed rate (e.g. in Kg [kilograms] per hour) divided by the weight of the catalyst. Likewise, the above-mentioned values are being provided for example purposes only and, accordingly, may be varied as necessary and appropriate. With particular reference to the processing of chlorinated alkanes as the halocarbon chosen for treatment in the claimed methods, an exemplary weight hourly space velocity will involve about 1–10 Kg of chlorinated alkane per Kg of catalyst composition per hour ($hr^{-1}$). Regarding the treatment of chlorinated aromatic compounds, typical and preferred weight hourly space velocities will be about 0.01–0.1 Kg of chlorinated aromatic compound per Kg of catalyst composition per hour ($hr^{-1}$). Notwithstanding the specific information listed above, it is important to recognize the functional abilities of the chosen catalyst in catalyzing and promoting the dehalogenation processes of interest in order to ensure that maximum yields of dehalogenated product are achieved at an effective reaction rate.

C. The Solvent

A number of different solvent materials and quantities can be employed in the claimed processes without restriction. However, some specific examples of effective solvents will now be discussed. The solvent materials of interest in the present invention can generally be divided into two-main classes as previously stated. The first class involves a solvent composition which contains as part of its chemical structure (e.g. formula) at least one hydrogen (H) atom. This particular solvent is most frequently referred to hereinafter as a "hydrogen-containing solvent". The second solvent type consists of a solvent material which does not contain any hydrogen atoms as part of its chemical structure (e.g. formula). It is most frequently referred to hereinafter as a "non-hydrogen-containing solvent". However, it should also be noted that, unless otherwise indicated, whenever the term "solvent" is employed, it shall be construed to collectively encompass all solvent types applicable to the claimed processes including but not limited to both of the varieties recited above. These solvent classes will now be discussed in further detail.

Regarding hydrogen-containing solvents, a large number of diverse chemical compositions within this class can be used for the purposes expressed herein (namely, salvation of the halocarbon compounds). These materials include but are not limited to the following general groups of organic compositions: alcohols (long and short chain variants thereof), alkanes, ketones, aldehydes, aromatic compounds, or other related and functionally comparable compositions. Specific materials within one or more of the foregoing groups that can be employed efficiently as hydrogen-containing solvents in the claimed processes include without restriction: methane, ethane, propane, butane, pentane, hexane, acetone, methanol, ethanol, isopropanol, hexanol, toluene, ethylbenzene, isomers of the foregoing materials (including cyclo-, n-, and other forms), other functionally equivalent compositions, or mixtures thereof. Various other solvent materials which may be used in the inventive techniques disclosed herein are also set forth in Table 1 below. It must again be emphasized that many different solvents can be employed in the claimed processes without limitation which is a key aspect of the overall versatility thereof.

The second type of solvent as previously stated consists of a non-hydrogen-containing solvent. Exemplary and preferred non-hydrogen-containing solvents will include, for instance, carbon dioxide ($CO_2$), carbon monoxide (CO), xenon (Xe), nitrogen dioxide ($NO_2$), nitrous oxide ($N_2O$), nitric oxide (NO), carbon disulfide ($CS_2$), isomers of the foregoing materials, other functionally equivalent compositions, or mixtures thereof. Again, a large number of different solvent compounds (both hydrogen-containing and non-hydrogen-containing can be used to accomplish the various goals of the current invention).

With reference to the FIGURE, a supply 24 of a selected solvent is schematically illustrated which is operatively connected to and in fluid communication with the interior region 14 of the reactor vessel 16 via tubular conduit 26. Once again, the configuration of components illustrated in the FIGURE shall be considered entirely non-limiting and representative in nature. It should also be noted as previously stated that employment of the term "solvent" herein and as claimed shall signify the use of either a hydrogen-containing solvent, a non-hydrogen-containing solvent, or a combination of both types.

At this time, the possible need for an additional (e.g. supplemental) composition which is capable of donating hydrogen atoms to the claimed dehalogenation processes will be discussed in detail. In order to effectively dehalogenate the halocarbon compositions of concern, a sufficient quantity of hydrogen atoms are necessary within the reaction environment. Specifically, this amount must be high enough to achieve complete halogen "substitution". In accordance with the above-mentioned substitution process, one or more halogen atoms in the halocarbon compound are replaced with one or more hydrogen atoms. As a result, the desired dehalogenated product is generated which is central to the operational theory associated with the current invention. In a preferred and optimum embodiment, the solvent (for example, supply 24 in the FIGURE) that is chosen for use in the claimed processes will have a "dual-function" capacity, namely, the ability to function as both (1) a solvent which is effective in solvating the halocarbon of interest; and (2) a hydrogen donating composition that will deliver sufficient hydrogen atoms to the reaction process for rapid, effective, and complete dehalogenation. Many different dual-function solvents can be employed for the purposes expressed herein including but not limited to hexane, acetone, methanol, ethanol, isopropanol, isomers of the foregoing compounds (-, cyclo-, and others), functionally equivalent materials, or mixtures thereof. Thus, by using these compositions as solvents, dehalogenation is accomplished in accordance with the following general reaction scheme:

$$RX \xrightarrow[\text{(catalyst, hydrogen-containing solvent)}]{} RH + HX \qquad (1)$$

(wherein [R]=any carbon-containing material; [X]=any halogen; [H]=a hydrogen atom; [catalyst]=as discussed above).

It should be noted that, while a variety of organic compositions have been discussed above regarding the hydrogen-containing solvent, it should also be recognized that the present invention shall not be restricted to only organic hydrogen-containing solvents. Other solvent materials which are not organic in nature but are nonetheless able to effectively donate hydrogen atoms in the manner shown above in Equation (1) may also be employed without limitation. Representative examples of non-organic hydrogen-containing solvents include but are not limited to ammonia ($NH_3$), boranes, other functionally equivalent materials, or mixtures thereof.

In a further variant of the invention, another reactant may be used in combination with the solvent, halocarbon compound, and catalyst. This additional reactant (which would be considered optional in certain circumstances and non-optional in others) involves a material characterized herein as a "hydrogen donor composition", a "hydrogen donor", a "supplemental hydrogen donor composition", or a "supplemental hydrogen donor". All of these phrases shall encompass a composition which, in the claimed processes, is capable of yielding one or more hydrogen atoms. It is typically employed in situations where (1) a non-hydrogen-containing solvent is used; and (2) a hydrogen-containing solvent is employed which (as determined by routine preliminary pilot testing) has a chemical configuration that is not capable of permitting sufficient amounts of hydrogen atoms to be released therefrom to effectively accomplish dehalogenation. Accordingly, a hydrogen donor composition is employed on an as-needed basis with particular reference to the particular solvents under consideration.

When a non-hydrogen-containing solvent is used in the reaction mixture, the importance of a hydrogen donor composition therein is self-evident. However, in situations involving hydrogen-containing solvents, preliminary pilot studies may again be used to determine whether the employment of a separate hydrogen donor composition is appropriate. It is also possible to reach some general conclusions involving the need for a hydrogen donor composition in a given situation which will now be summarized. For example, the employment of solvents comprised of low molecular weight alkanes will often (but not necessarily) require the addition of at least one or more hydrogen donor compositions (e.g. as additional ingredients) in order to achieve rapid and complete dehalogenation. These low molecular weight alkane solvents include but are not limited to $C_1$ to $C_4$ compositions (for example, methane, ethane, propane, and butane). The differences between lower and higher-level carbon compositions (e.g. solvents) from a hydrogen donation standpoint are demonstrated by the fact that, for instance, 1 mole of methanol can provide 4 moles of hydrogen atoms (H) during dehalogenation. However, one mole of n-hexane can yield 14 moles of hydrogen atoms (H) under similar circumstances.

While the particular guidelines recited above are generally applicable to most situations (and can therefore be used to determine the need for a hydrogen donor composition in addition to the solvent), these guidelines may be subject to certain exceptions as determined by routine preliminary experimentation. For example, the need for a hydrogen donor composition (in addition to a hydrogen-containing solvent) can also depend on the chemical character of the halocarbon that is being treated. The relevance of this factor is demonstrated when, for instance, chlorobenzene and 1,1,1-trichloroethane are compared with particular reference to the amount of hydrogen needed to accomplish dehalogenation. Chlorobenzene has 1 halogen atom (e.g. Cl) and thus requires 1 mole of hydrogen atoms (H) in order to effectively dehalogenate this material. In contrast, 1,1,1-trichloroethane has 3 halogen atoms (e.g. Cl) and thus requires a greater amount of hydrogen for the dehalogenation process, namely, 3 moles of hydrogen atoms (H). Accordingly, the chemical character of the halocarbon compound selected for treatment can be an important factor in determining if and when a separate hydrogen donor composition should be employed. In a preferred embodiment designed to provide maximum efficiency, a separate hydrogen donor composition would be used automatically as a default measure whenever, for example, (1) low molecular weight carbon compositions are employed as solvent materials (for example, $C_1$ to $C_4$ alkanes including but not limited to methane, ethane, propane, butane, and other compositions which are determined [at least theoretically] to have similar hydrogen yielding capabilities); and/or (2) halocarbons are involved which would include more than one halogen atom per molecule. Under these circumstances (and others as determined by appropriate calculations), one or more hydrogen donor compositions would be employed on an automatic, default basis as part of the reaction process. Likewise, the decision to incorporate into the reaction mixture a separate hydrogen donor composition in addition to the solvent could again be based on preliminary pilot testing involving the materials being reacted with emphasis on the specific halocarbon composition designated for destruction.

Regarding the terminology employed herein, the phrase "hydrogen donor composition" or "hydrogen donor" will typically be used when non-hydrogen-containing solvents are employed in the claimed processes. When hydrogen-containing solvents are involved, the more appropriate phrase to be used will instead be "supplemental hydrogen donor composition" or "supplemental hydrogen donor" since the solvents in such a situation will still be able to donate at least some hydrogen under most circumstances (albeit in small quantities depending on the materials under consideration). However, it should likewise be understood that, as claimed and set forth in the present discussion, "hydrogen donor composition", "hydrogen donor", "supplemental hydrogen donor composition", and "supplemental hydrogen donor" shall all be used interchangeably and equivalently to identify the particular compositions designed to donate hydrogen atoms during dehalogenation irrespective of the type of solvent being used. In this regard and as previously explained, term "hydrogen donor composition" or "hydrogen donor" shall be construed herein to generally encompass both supplemental and non-supplemental hydrogen donors.

When a hydrogen donor composition (supplemental or otherwise) is used as described above, dehalogenation is accomplished in accordance with the following general reaction scheme:

$$\mathrm{RX} \xrightarrow[\text{(catalyst, solvent)}]{\text{(hydrogen donor composition)}} \mathrm{RH} + \mathrm{HX} \qquad (2)$$

(wherein [R]=any carbon-containing material; [X]=any halogen; [H]=a hydrogen atom; [catalyst]=as discussed above; [solvent] =as also discussed above; and [hydrogen donor composition]=to be discussed below).

Representative hydrogen donor compositions will now be described. It should be recognized that the present invention is not restricted to any particular materials in connection with the hydrogen donor composition, with virtually any compound (organic or otherwise) being suitable for this purpose provided that it is capable of delivering, donating, or otherwise transferring one or more hydrogen atoms during the dehalogenation process (e.g. see Equation [2]). For example, a wide variety of alcohols, alkanes, alkenes, aldehydes, ketones, and the like can be used as hydrogen donor compositions. Exemplary and preferred materials from one or more of the above-listed categories (or others) which are appropriate for addition to the reaction mixture as hydrogen donor compositions include but are not limited to hexane, acetone, methanol, ethanol, isopropanol, isomers thereof (including cyclo-, n-, and other forms), compositions equivalent thereto, or mixtures of the foregoing compounds.

Regarding specific amounts of the above-listed materials to be incorporated within the claimed methods, a wide variety of different quantities can be used without limitation. Accordingly, the present invention shall not be restricted to any particular quantity values with respect to each of the foregoing reactants (solvents, hydrogen donor compositions, catalysts, and halocarbons). Routine preliminary experimentation can be used to determine the precise amounts of these materials which will necessarily vary from situation to situation depending on many factors including, for instance, the type of halocarbon compound designated for destruction, the overall scale of the reactor system, and other related factors. However, exemplary and preferred solvent and/or hydrogen donor composition levels which are prospectively applicable to all of the various embodiments set forth herein are as follows:

(A) If no separate hydrogen donor compositions are employed and a dual-function hydrogen-containing solvent is used as previously discussed, the solvent will be present in a preferred and representative solvent : halocarbon weight ratio of about 1:1 to 1:1000 (optimum=about 5:1 to 100:1), with the foregoing numbers being subject to variation if needed and desired.

(B) If either [i] a non-hydrogen-containing solvent or [ii] a non-dual-function hydrogen-containing solvent (namely, one that contains hydrogen in insufficient quantities to accomplish rapid and effective dehalogenation) is used, the solvent will be present in a preferred and representative solvent:halocarbon weight ratio of about 1:1 to 1000:1 (optimum= about 5:1 to 100:1). A hydrogen donor composition will likewise be employed along with the solvent. In an exemplary and non-limiting embodiment, the hydrogen donor composition will be incorporated into the reaction mixture in a hydrogen donor composition:halocarbon atomic ratio of H:X of about 1:1 to 100:1 (optimum=about 2:1 to 10:1). Again, all of these numbers (and the other numerical parameters expressed herein) may be suitably varied as appropriate and necessary.

It should likewise be understood that all of the numerical quantity values expressed above and throughout this discussion shall involve the total (e.g. collective) amount of the chemical composition under consideration (e.g. halocarbon compound, solvent, hydrogen donor composition, catalyst, etc.) whether a single material is employed or multiple materials are used in combination. For example, in the above-listed ratios, the numerical value associated with the solvent will involve the total quantity of solvent whether this quantity involves only one solvent or more than one solvent in combination. The same principle is applicable to all of the other numbers set forth herein which pertain to material quantity. It should also be recognized that, in a preferred embodiment and irrespective of which materials are used, a stoichiometric excess of the hydrogen source (e.g. solvent and/or hydrogen donor composition) relative to the halocarbon is considered to be desirable in most situations. In the foregoing sentence and throughout this discussion, the term "hydrogen source" shall encompass the solvent (if appropriately and sufficiently hydrogen-containing) and/or the hydrogen donor composition (whether or not it is "supplemental").

Finally and as previously noted, the FIGURE schematically illustrates a supply 24 of solvent (encompassing any of the particular types and examples listed above) which is operatively connected to and in fluid communication with the interior region 14 of the reactor vessel 16 via tubular conduit 26. Likewise, a supply 30 of a hydrogen donor composition (involving any of the particular types and examples set forth herein) is shown in the FIGURE which is operatively connected to and in fluid communication with the interior region 14 of the reactor vessel 16 via tubular conduit 32. Notwithstanding the presence of a hydrogen donor composition in the schematic representation of the FIGURE (e.g. supply 30), the use of this material shall not be required in all circumstances with the employment thereof being based on the factors recited above.

D. Reaction Conditions

The preferred, novel, and effective reaction conditions associated with the claimed invention will now be discussed in detail. As previously stated, the specific temperature and/or pressure conditions that are used in connection with the selected solvent are instrumental in achieving the many benefits listed above including but not limited to increased reaction rates, improved mass transport, greater solubility of the reactants during system operation, better system versatility with particular reference to the types of halocarbon compounds that can be processed, enhanced catalyst cleaning characteristics, and the like. Accordingly, it is an inventive and novel aspect of the claimed invention to employ the reaction conditions discussed below and to consciously choose these conditions over the many others that are theoretically possible.

During the dehalogenation procedures disclosed herein, the solvent (whether or not it contains hydrogen) is maintained at one of a plurality of highly specialized and carefully chosen temperature and/or pressure conditions. It is a common feature of all the various embodiments outlined in this section that the solvent be maintained at a "critical" state throughout at least part or (preferably) all of the dehalogenation reaction. The term "critical" as used this manner shall again encompass all of the embodiments recited below and will likewise involve a situation where at least one of the temperature (T) and pressure (P) of the solvent is maintained at near-critical, critical, or above-critical levels.

The preferred reaction conditions which are encompassed within the general concept set forth above will now be explained in greater detail. For the purpose of this discussion, the following terminology is relevant and defined in accordance with established and generally-accepted definitions: (A) "Critical Temperature"=($T_c$)=The temperature for a given substance where, if this temperature is exceeded, the substance will have no liquid-vapor transition (namely, a condensed liquid phase cannot be produced no matter how much pressure is applied); (B) "Critical Pressure"=($P_c$)=The pressure for a given substance at its liquid-vapor critical point; and (C) "Supercritical"=a physical state associated with a given substance wherein the pressure (P) thereof exceeds its critical pressure ($P_c$) and the temperature (T) thereof also exceeds its critical temperature ($T_c$). It should likewise be understood that the terms "(P)" and "(T)" shall be used herein to designate the chosen pressure and temperature, respectively, of the solvent during the claimed dehalogenation methods.

Various other terms of consequence in the current discussion are as follows:

(1) "Near-Critical Temperature"=($T_{nc}$) wherein the following relationship is applicable: $[(0.9)(T_c)] \leqq (T_{nc}) < (T_c)$. In other words, the near-critical temperature ($T_{nc}$) is greater than or equal to (≧) about $[(0.9)(T_c)]$ and less than (<) ($T_c$) in a preferred embodiment. In all of the relationships expressed herein involving the temperature (T), near-critical temperature ($T_{nc}$), and critical temperature ($T_c$) of the solvent which include numerical values associated therewith, the listed temperature relationships shall all be interpreted in the current discussion and in the claims as if they were on an "absolute" temperature scale (e.g. in ° K [wherein ° K=° C.+273.16] or ° R [wherein ° R=° F.+459.67]). Likewise, the term "absolute temperature" and "absolute temperature scale" shall be conventionally defined to encompass the use of a temperature measuring system in which all temperatures are measured relative to absolute zero. Furthermore, it should be understood that when a number such as, for example, (0.9) is positioned against a variable such as ($T_c$)

to yield the relationship [(0.9)($T_c$)], this relationship shall be interpreted to involve a situation where 0.9 is multiplied by ($T_c$). This guideline is likewise applicable to all other relationships and embodiments expressed herein where a variable is positioned adjacent a chosen numerical FIGURE in a manner comparable to that which is recited above.

(2) "Near Critical Pressure"=($P_{nc}$) wherein the following relationship is applicable: [(0.1)($P_c$)]≦($P_{nc}$)<($P_c$) In other words, the near-critical pressure ($P_{nc}$) is greater than or equal to (≧) about [(0.1)($P_c$)] and less than (<) ($P_c$) in a preferred embodiment. In all of the relationships expressed herein involving the pressure (P), near-critical pressure ($P_{nc}$), and critical pressure ($P_c$) of the solvent which include numerical values associated therewith, the listed pressure relationships shall all be interpreted in the current discussion and in the claims as if they were on an "absolute" pressure scale (e.g. in atmospheres ["atm"] or pounds per square inch absolute ["psia"] as opposed to "gauge" pressure [for example, pounds per square inch gauge or "psig"]). Both "absolute pressure" and "absolute pressure scale" shall be conventionally defined to encompass a situation wherein the pressure under consideration is measured or determined with specific reference to the atmosphere and not to a "gauge" environment.

As an initial step in selecting the particular reaction conditions that are desired in connection with the claimed processes, the first step involves determining the critical temperature ($T_c$) and critical pressure ($P_c$) of the solvent being used. This step is employed since the overall condition of the solvent during dehalogenation is based on its critical temperature ($T_c$) and critical pressure ($P_c$) characteristics which are used as a point-of-reference for this purpose. Solvent critical temperature ($T_c$) and critical pressure ($P_c$) values are readily available from a multitude of standard reference sources including but not limited to the many editions of the *CRC Handbook of Chemistry and Physics* published by CRC Press, Inc. of Cleveland, Ohio (USA) [including, without limitation, the $55^{th}$ ed. (1974–1975), p. F-79]. For example purposes, Table 1 set forth below provides representative critical temperature ($T_c$) and critical pressure ($P_c$) values for various materials which may be used as solvents and/or hydrogen donor compositions in the claimed methods:

TABLE 1

| Material | Critical Temperature (° K) | Critical Pressure (atm) |
|---|---|---|
| Methane | 190.6 | 46.6 |
| Ethane | 305.4 | 49.5 |
| Propane | 369.8 | 43.1 |
| n-Butane | 425.2 | 38.5 |
| n-Pentane | 469.6 | 34.1 |
| Carbon Dioxide | 304.1 | 74.8 |
| n-Hexane | 507.4 | 30.5 |
| Acetone | 508.1 | 47.6 |
| Methanol | 513.1 | 82.0 |
| Ethanol | 516.2 | 62.6 |
| Isopropanol | 508.8 | 48.2 |
| Ethylene | 282.2 | 49.7 |
| Nitrous Oxide | 309.2 | 71.5 |
| Propylene | 365.2 | 45.6 |
| Ammonia | 405.2 | 111.3 |
| Toluene | 591.2 | 40.6 |

The materials in the foregoing table shall be considered non-limiting in nature and, in particular, involve representative compounds which may be used as solvents and/or hydrogen donor compositions. In the above-mentioned table, it shall be generally understood that the compositions which do not contain any hydrogen atoms are applicable for use as solvents only, with the hydrogen-containing materials being employable as solvents and/or hydrogen donor compositions in accordance with the standards and guidelines presented above. Furthermore, the particular numbers in Table 1 are approximate only.

Preferred and desired operating conditions with particular reference to the solvent temperature (T) and/or pressure (P) will now be recited in detail. It is again important to emphasize that the conscious selection and implementation of the conditions expressed herein is instrumental in achieving the many benefits listed throughout the current discussion including but not limited to increased reaction rates, improved mass transport, greater solubility of the reactants during system operation, better catalyst cleaning capabilities, and the like. It is therefore an inventive and novel aspect of the claimed invention to employ the reaction conditions summarized below and to consciously choose these solvent conditions over others. Such conditions are as follows:

(A) Condition No. 1—A supercritical state (namely, where the temperature (T) of the solvent is maintained at or above its critical temperature ($T_c$) and the pressure (P) of the solvent is maintained at or above its critical pressure ($P_c$) during at least part or preferably all of the foregoing reaction. When supercritical conditions are employed, a preferred version of this particular embodiment will involve a situation where the solvent is maintained at a solvent temperature (T)=about ($T_c$) to [(2)($T_c$)] and a solvent pressure (P)=about ($P_c$) to [(50)($P_c$)]. Regarding all of the numerical parameters discussed herein, such values shall not be considered limiting and instead constitute preferred operating conditions designed to provide optimum results. Likewise, with particular reference to the numerical relationships expressed in this paragraph (and as claimed), these relationships shall involve a situation where the pressure (P), near-critical pressure ($P_{nc}$) critical pressure ($P_c$), temperature (T), near-critical temperature ($T_{nc}$), and critical temperature ($T_c$) values associated with the solvent are all interpreted to be on an absolute scale as previously defined. It also should be noted that, while the other embodiments set forth below are effective, novel, and distinctive, the employment of a supercritical solvent system in the present invention shall be considered the preferred version thereof.

(B) Condition No. 2—A state wherein the solvent is maintained at a solvent temperature (T)≧($T_c$) and a solvent pressure (P)≦($P_c$) during at least part or preferably all of the aforesaid reaction. In this particular embodiment, an exemplary and preferred solvent pressure (P) level will involve a situation where the pressure (P) of the solvent is ≧about [(0.1)($P_c$)] (which would encompass [e.g. include] the near-critical solvent pressure [$P_{nc}$] region as previously defined). Likewise, a representative and preferred solvent temperature (T) will be sustained at a level=about ($T_c$) to [(2)($T_c$)]. In the definition of near-critical pressure ($P_{nc}$) as stated above, as well as the other numerical relationships expressed in this paragraph (and as claimed), the pressure (P), near-critical pressure ($P_{nc}$), critical pressure ($P_c$) temperature (T), near-critical temperature ($T_{nc}$), and critical temperature ($T_c$) values associated with the solvent shall all be interpreted to involve those on an absolute scale.

(C) Condition No. 3—A state wherein the solvent is maintained at a solvent temperature (T)≦($T_c$) and a solvent pressure (P)≧($P_c$) during at least part or preferably all of the foregoing reaction. In this particular embodiment, an exemplary and preferred solvent pressure (P) level will involve a situation where the pressure (P) of the solvent=about ($P_c$) to [(50) ($P_c$)]. Likewise, a representative and preferred solvent temperature (T) level will be sustained at a level which is ≧about [(0.9)($T_c$)] (which would encompass the near-critical solvent temperature [$T_{nc}$] region as previously defined). Again, in the definition of near-critical temperature ($T_{nc}$) as stated above, as well as the other numerical relationships expressed in this paragraph (and as claimed), the pressure (P), near-critical pressure ($P_{nc}$), critical pressure ($P_c$) temperature (T), near-critical temperature ($T_{nc}$), and critical temperature ($T_c$) values associated with the solvent shall all be interpreted to involve those on an absolute scale.

(D) Condition No. 4—In a state wherein the solvent is maintained at a solvent temperature (T)≦($T_c$) and a solvent pressure (P) which is ≧about [(0.1)($P_c$)] and ≦($P_c$) (e.g. encompassing the near-critical solvent pressure [$P_{nc}$] region) during at least part or preferably all of the aforesaid reaction. When this particular embodiment is implemented, a representative and preferred solvent temperature (T) will be ≧about [(0.9)($T_c$)] (which would likewise encompass the near-critical solvent temperature [$T_{nc}$] region). However, near critical solvent temperature ($T_c$) values are not necessarily mandated in this embodiment. Once again, in the definitions of near-critical temperature ($T_{nc}$) and near-critical pressure ($P_{nc}$) as stated above, as well as the other numerical relationships expressed in this paragraph (and as claimed), the pressure (P), near-critical pressure ($P_{nc}$), critical pressure ($P_c$) temperature (T), near-critical temperature ($T_{nc}$), and critical temperature ($T_c$) values associated with the solvent shall all be interpreted to involve those on an absolute scale.

(E) Condition No. 5—In a state wherein the solvent is maintained at a solvent pressure (P)≦($P_c$) and a solvent temperature (T) which is ≧about [(0.9)($T_c$)] and ≦($T_c$) (e.g. encompassing the near-critical solvent temperature [$T_{nc}$] region) during at least part or preferably all of the aforesaid reaction. When this particular embodiment is implemented, a representative and preferred solvent pressure (P) is ≧about [(0.1)($P_c$)] (which would likewise encompass the near-critical solvent pressure [$P_{nc}$] region). However, near-critical solvent pressure ($P_{nc}$) values are not necessarily mandated in this embodiment. Once again, in the definitions of near-critical temperature ($T_{nc}$) and near-critical pressure ($P_{nc}$) as previously stated, as well as the other numerical relationships expressed in this paragraph (and as claimed), the pressure (P), near-critical pressure ($P_{nc}$), critical pressure ($P_c$) temperature (T), near-critical temperature ($T_{nc}$), and critical temperature ($T_c$) values associated with the solvent shall all be interpreted to involve those on an absolute scale.

Summarized another way, the preferred reaction conditions associated with the present invention (with particular reference to the state of the solvent) involve a situation wherein the solvent temperature (T) is defined as follows: [(0.9)($T_c$)]≦(T)≦[(2)($T_c$)] and/or the solvent pressure (P) is defined as follows: [(0.1)($P_c$)]≦(P)≦[(50)($P_c$)]. With particular reference to all of the solvent states outlined above, some additional points of information are relevant. First, with respect to solvent temperature (T) and pressure (P) values that are at or above critical levels, there shall be no upper limits associated therewith aside from those that generally pertain to system-specific factors involving cost, practicality, and reactor capacities/tolerances. Regarding solvent temperature (T) and pressure (P) values below critical levels in the options described herein, near-critical solvent temperatures ($T_{nc}$) and near-critical solvent pressures ($P_{nc}$) are preferred. However, lower levels (e.g. less than near-critical) are possible provided that at least one of the temperature (T) and pressure (P) of the solvent is maintained at a near-critical, critical, or above-critical level during all or part of the dehalogenation process. As to how low such levels may go, there are no limits associated therewith other than those which generally pertain to system-specific factors involving cost, practicality, and reactor capacities/tolerances.

The technological developments of the present invention provide many important benefits compared with prior systems that operate outside of the solvent states recited above. These benefits include but are not restricted to: (1) improved reaction rates; (2) more advantageous material transport characteristics (e.g. favorable "mass transport" properties) resulting in the rapid and efficient production of dehalogenated products; (3) the ability to avoid generating large quantities of additional toxic materials as reaction by-products; (4) a high level of versatility with particular reference to the types of compositions that can be dehalogenated; (5) reduced production facility costs compared with, for instance, incineration systems; (6) the elimination of high-temperature combustive reactors and the energy requirements associated therewith; (7) the ability to accomplish complete destruction of the desired halogenated compounds without requiring highly reactive (e.g. dangerous) reducing agents and other comparable materials; (8) the further ability to employ low-cost and safer reactants; (9) the implementation of processes which are cost effective, readily controllable (e.g. customizable on-demand), easily scaled up or down as needed, and capable of rapid integration with other processing systems including those used for extraction and separation of reaction products; (10) greater catalyst life; (11) enhanced and improved catalyst cleaning characteristics; (12) more advantageous reaction kinetics; (13) the ability in certain situations to recycle reaction products back into the system for use as reactants and in various related applications; and other benefits.

While the manner in which the claimed invention provides the foregoing advantages is not entirely understood from a chemical and physical standpoint, it is contemplated that at least some of the above-listed benefits result from the improved physical properties of the solvent which occur when the foregoing reaction conditions are employed including (with specific reference to the solvent) a liquid-like density, gas-like diffusion, and favorable changes in solubility characteristics. It should nonetheless be understood that the present invention shall not be limited to any of these mechanisms or explanations which are being provided for informational purposes only.

As previously stated, the methods disclosed herein shall not be considered "reactor-specific". They will not require any particular material conveying systems, conduits, reactor structures, or other types of hardware. The illustration of the FIGURE is therefore highly schematic and representative only. Accordingly, maintenance of the desired operating conditions (and dehalogenation in general) may occur using any equipment, reactors, control systems, and the like which are known by those skilled in the art to which this invention pertains. For example, with reference to the FIGURE, supplies 12, 24, 30 of halocarbon, solvent, and hydrogen donor composition may have pumps/compressors 34, 36, 40 associated therewith as schematically illustrated. These pumps/compressors 34, 36, 40 can involve many different types including but not limited to those which are conventionally known in the art for delivery of the materials under consideration. Alternatively, the supplies 12, 24, 30 of the aforementioned materials may be suitably pressurized as determined by routine preliminary experimentation in order to accomplish rapid and continuous delivery thereof into the reactor vessel 16 on-demand. The dehalogenation procedures of interest may be carried out in a number of different operating modes including batch and continuous configurations depending on the quantity of the halocarbon designated for destruction and other factors. Flow rates associated with the chosen reactants may be varied as needed and determined in accordance with routine preliminary testing based on many considerations including the overall size of the processing system 10, the type of halocarbon compound involved, and the like, with the present invention not being limited in this respect.

Regarding maintenance of the temperature conditions expressed herein, the reactor vessel 16 will typically comprise a suitable heating system 42 associated therewith (schematically shown in the FIGURE) which can involve many different types including electrical resistance units and other varieties. All of the information set forth above confirms that many different component arrangements may be used to accomplish the desired reactions under the preferred operating conditions expressed herein.

The reaction product of the dehalogenation techniques disclosed herein (schematically shown at reference number 44 in the FIGURE) flows through tubular conduit 46 from the interior region 14 of the reactor vessel 16 for passage into a collection/separation system 50 of conventional design. The collection/separation system 50 is used to isolate, retain, and/or separate various compositions from the reaction product 44 if desired. The present invention shall not be restricted to any particular apparatus for use as the collection/separation system 50, with a number of different devices being suitable. Any appropriate apparatus can be used for this purpose which is known by those skilled in the art of chemical separation. For instance, the collection/separation system 50 may involve a conventional collecting unit that could include, for instance, (1) a "cold trap" used to isolate liquid dehalogenated organic materials; (2) an activated carbon supply for isolating and retaining gaseous materials; and (3) a sodium hydroxide (NaOH) scrubber which is employed to neutralize various acids that may be formed during dehalogenation.

Prior to separation by the collection/separation system 50 as discussed above, the reaction product 44 will normally include the dehalogenated compound of interest (e.g. the dehalogenated product which will typically involve the hydrogenated analog of the halocarbon that was treated), hydrohalic acid, carbon monoxide (CO), alkane fragments, alkenes, any excess amounts of the reactants including the solvent and hydrogen donor composition (if used), and the like. After processing of the reaction product 44 has been completed within the collection/separation system 50, the isolated compositions (with one of them being schematically illustrated in the FIGURE at reference number 52) can be routed via tubular conduit 54 into a conventional analyzer unit 56. Within the analyzer unit 56, the isolated composition 52 of interest is quantitatively and/or qualitatively analyzed. A number of different devices may be used in connection with the analyzer unit 56 including but not limited to standard gas chromatographs, mass spectrometers, and the like. At this point, the overall process is completed and the reaction products can be suitably stored, disposed-of, recycled back into the processing system 10, employed in other chemical reactions, or otherwise addressed in whatever manner is considered to be appropriate. Again, the claimed methods shall not be restricted to any particular isolation, collection, separation, analysis, or other post-treatment systems, with the present invention instead being directed to the novel and effective dehalogenation techniques outlined above.

As previously stated, implementation of the processes disclosed herein provides many key benefits in a simultaneous fashion. Likewise, it has been determined that the employment of near-critical, critical, or above-critical solvent temperature (T) and/or pressure (P) levels during dehalogenation can achieve the following goals compared with systems operating outside of the above-mentioned parameters: (i) the promotion of greatly increased reaction rates (about 10-fold [e.g. 1000%] or higher in many cases); (ii) the ability to use lower temperature reaction conditions; and (iii) an increase in catalyst longevity by hindering or otherwise delaying premature catalyst deactivation. In this regard, the specific, conscious, and intentional selection of the solvent temperature (T) and/or pressure (P) conditions expressed above represents a significant advance in the art of halocarbon compound destruction.

Having set forth herein preferred embodiments of the invention, it is anticipated that various modifications may be made thereto by individuals skilled in the relevant art to which this invention pertains which nonetheless remain within the scope of the invention. For example, the invention shall not be limited to any particular halocarbons, solvents, hydrogen donor compositions (supplemental or otherwise), reactor components, material quantities, reactant delivery parameters, and the like unless otherwise explicitly stated above. The present invention shall therefore only be construed in accordance with the following claims.

The invention that is claimed is:

1. A method for dehalogenating a halocarbon comprising:

providing a supply of a halocarbon; and combining said halocarbon with a solvent which is comprised of a material selected from the group consisting of carbon monoxide, xenon, nitrogen dioxide, nitrous oxide, nitric oxide, carbon disulfide, and mixtures thereof and a hydrogen donor composition in the presence of a catalyst in order to cause a reaction which generates a dehalogenated product from said halocarbon, said solvent being maintained at a supercritical state during said reaction.

2. The method of claim 1 wherein said solvent has a critical temperature ($T_c$) and a critical pressure ($P_c$), said solvent being maintained during said reaction at a temperature (T)=about ($T_c$) to [(2)($T_c$)] and a pressure (P)=about ($P_c$) to [(50)($P_c$)].

* * * * *